United States Patent [19]

von Allworden

[11] 4,438,690

[45] Mar. 27, 1984

[54] PNEUMATICALLY OPERATED PRESS

[75] Inventor: Wilhelm von Allworden, Erbach, Fed. Rep. of Germany

[73] Assignee: Howard Machinery Limited, Harleston, England

[21] Appl. No.: 347,555

[22] Filed: Feb. 10, 1982

[30] Foreign Application Priority Data

Feb. 12, 1981 [DE] Fed. Rep. of Germany ..... 3105049

[51] Int. Cl.[3] ..... B30B 5/02; B30B 9/22

[52] U.S. Cl. ..... 100/116; 100/107; 100/211

[58] Field of Search ..... 100/116, 211, 107, 108, 100/110, 112, 121, 126, 37; 210/350, 351

[56] References Cited

U.S. PATENT DOCUMENTS

| | | | |
|---|---|---|---|
| 2,882,815 | 4/1959 | Bernier | 100/211 X |
| 4,024,810 | 5/1977 | Braun | 100/116 |
| 4,140,051 | 2/1979 | Huaser et al. | 100/211 X |
| 4,350,089 | 9/1982 | Braun | 100/116 |

FOREIGN PATENT DOCUMENTS

| | | | |
|---|---|---|---|
| 70683 | 4/1952 | Netherlands | 100/211 |

*Primary Examiner*—Pete Feldman

*Attorney, Agent, or Firm*—Wood, Dalton, Phillips, Mason & Rowe

[57] ABSTRACT

A pneumatically operated press, particularly for pressing grapes, has a cylindrical drum which is rotatable about a horizontal axis.

An internal membrane separates the drum into a pressing space in which the groups are pressed and an air space to which compressed air is introduced.

A side wall of the drum defining the pressing space is perforated for passing the juice from the space and an opening in this side wall admits the grapes before and after pressing.

The drum is cylindrical with the perforated side wall comprising half the drum surface and presenting a smooth surface to the membrane.

The membrane is connected to the drum at opposite sides of its axis by connecting strips.

7 Claims, 4 Drawing Figures

PNEUMATICALLY OPERATED PRESS

This invention relates to a pneumatically operated press for the separation of liquid from a mass of liquid and solids. The invention finds particular application in the extraction of juice from fruit such as grapes.

It has been proposed to provide a press having a rotatable drum with its axis horizontally disposed and defining an interior space which is subdivided by a membrane into two portions. One of the portions of the space accepts material to be pressed to release the liquid and includes an opening for receiving the material. The other portion of the space is sealed and is connected to a source of air under pressure to urge the membrane against the material and press the material.

A press of this kind is disclosed in U.S. Pat. No. 4,024,810 and in this prior press the space for the material to be pressed contains apertured drainage channels into which the liquid passes from the material. When the channels require to be cleaned each must be dismounted from the drum. Moreover the channels have sharp edges and during dismounting of the channels it is difficult to avoid damage to the channels which generates more sharp edges which can damage the membrane when it comes into contact therewith. This is particularly the case when pressing takes place with little material in the pressing space since the membrane is then pressed directly against the channels. The membrane is sensitive to any damage which affects the sealing of the portion of the space which is put under air pressure.

With the prior arrangement it is also important that the inlet for material is effectively sealed to prevent the inadvertent release of fluid through the inlet during use.

To guarantee adequate sealing of the inlet and of the air space in the drum requires that the press be constructed in an expensive manner.

An object of the invention is to provide a pneumatically operated press in which a decrease in constructional costs can be achieved and in which cleaning and maintenance is simplified.

According to the invention a pneumatically operated press comprises a rotatable drum having its axis horizontally disposed, a flexible membrane within the drum subdividing the interior of the drum into two spaces, a pressing space for receiving material to be pressed and an air space into which air under pressure is to be introduced to cause the membrane to be urged towards the pressing space, an inlet for introducing material to be pressed into the pressing space, and an outlet for enabling liquid in the material to be removed from the drum, the outlet being provided by openings in a side wall of the drum defining part of the pressing space.

Preferably the inlet is constituted by an aperture in said side wall, the aperture having a closure member and the closure member being formed with openings through which liquid passes during a pressing operation and the internal surface of the side wall in which the outlet openings are formed is smooth and curvilinear.

Conveniently the drum is cylindrical and a semi-cylindrical portion of the side wall of the drum defines with the membrane the pressing space, the other semi-cylindrical portion of the drum defining with the membrane the air space.

Further features of the invention appear from the following description of an embodiment of the invention given by way of example only and with reference to the drawings, in which.

Figure 1:
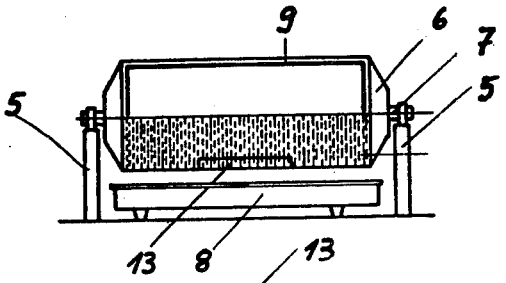
FIG. 1 is a schematic longitudinal section through a pneumatic press.

Referring to the drawings a pneumatic press includes a rotatable drum 6 having a horizontal axis of rotation 7 and mounted on a stand 5. A collecting vat 8 is located below the drum which is generally cylindrical having end walls and a cylindrical side wall.

A membrane 9 is secured in the interior of the drum 6 and is attached along its longitudinal edges by connecting strips 10 which lie parallel to the axis 7 and on opposite sides of the drum. Adjacent the attachment of the membrane 9 by the strips the membrane lies tangentially of the drum 6 to extend, as shown, towards the direction occupied by the membrane when commencing a pressing operation.

The membrane 9 sub-divides the interior of the drum into a pressing space 12 which is the space occupied by the material to be pressed, preferably grapes, and an air space 11 which is the space into which air under pressure from a source of compressed air (not shown) is introduced to cause the material to be pressed. The pressing space 12 is defined by one side of the membrane 9 and by a perforated or slotted semi-cylindrical portion of the side wall of the drum, as best seen in FIG. 1. The perforations or slots provide openings through which the liquid or juice from the material passes during the pressing operation to be collected in the vat 8. The internal surface of the drum in the pressing space provides a smooth, curvilinear surface which may be engaged by the membrane during the final stages of the pressing operation. An opening into the pressing space 12 for loading material to be pressed and for unloading pressed material, is formed in the drum and the opening is closed by a lid 13 which is also formed with perforations or slots through which the liquid passes. Thus the whole of the semi-cylindrical surface, including the lid 13, of the pressing space offers openings through which the liquid passes to the vat.

Figure 2:
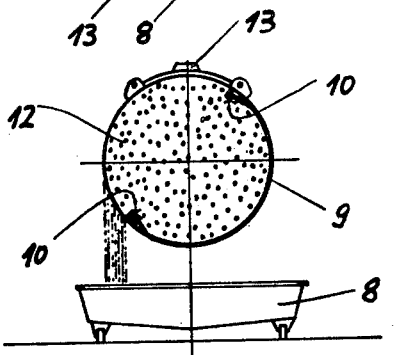
FIG. 2 is a transverse cross-section of the press of FIG. 1 shown immediately after a charge of material has been loaded into the press.

The lid 13 is positioned adjacent the connection of one edge of the membrane 9 to the drum 6 so that during filling of the drum with the opening directed upwardly (FIG. 2) fluid can pass to the vat through the perforations at the opposite side of the drum. In FIG. 1 filling had just been completed and the lid 13 fixed in place.

The air space 11 is defined by the other side of the membrane 9 and by an imperforate semi-cylindrical side wall of the drum so that the air space is sealed. The strips 10 are secured to the imperforate portion of the drum.

Figure 3:
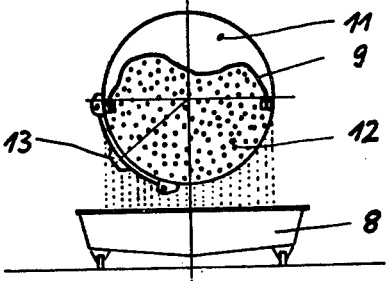
FIG. 3 is a transverse cross-section corresponding to FIG. 2 shown during a pressing operation.

As compressed air is introduced into the air space 11 the membrane 9 is urged towards the pressing space 12 reducing the volume thereof and expelling the liquid from the space 12 as shown in FIG. 3. During this operation the drum is rotated from the position of FIG. 2 so that the perforated portion of the drum is directed downwardly towards the vat 8.

Figure 4:
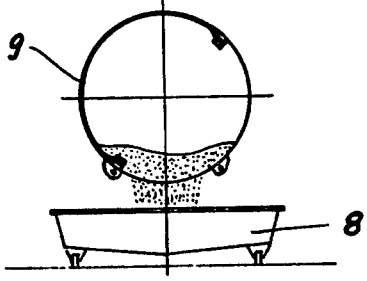
FIG. 4 is a transverse cross-section corresponding to FIGS. 2 and 3 shown during unloading, after completion of a pressing operation.

Upon completion of the pressing operation the lid 13 is opened or removed and the drum is rotated to the position shown in FIG. 4 for release of the pressed contents of the pressing space downwards through the opening. During this operation the membrane 9 is drawn back to the imperforate side wall by the application of a vacuum to the air space 11.

Conveniently the drum and lid are fabricated from stainless steel and it will be seen that the drum is easily cleaned without the need for dismantling the drum.

Moreover the smooth internal side walls of the drum avoid damage to the membrane.

The total area of the openings for the liquid to pass through to leave the drum is also relatively large and rapid emptying of the liquid is achieved.

Sealing of the lid for admitting and discharging the contents of the drum is no longer a problem as the lid now forms part of the side wall of the drum through which the liquid is intended to flow.

Simultaneous filling of material and discharge of liquid increases the capacity of the drum as more material can be admitted as the liquid is released.

Excess tension in the membrane is avoided by the method of attachment of the membrane using raised connecting strips 10. The surfaces of the drum engaged by the membrane are the same when the drum is empty or full, or when excess pressure is placed on the membrane. Moreover the connecting strips 10 are freely accessible through the opening so that the membrane is easily replaced.

What I claim as my invention and desire to secure by Letters Patent of the United States is:

1. A pneumatically operated press comprising, a rotatable drum having its axis of rotation disposed horizontally, a flexible membrane attached to the wall of the drum internally thereof and extending parallel to said axis of rotation so as to sub-divide the interior of the drum into two spaces, a pressing space and an air space, the pressing space being defined by said membrane and a portion of said wall, and said wall portion having a filling opening through which material to be pressed is introduced into the pressing space, a closure member for the filling opening which is located adjacent the attachment of the membrane to said wall, the portion of the drum defining the pressing space, including the closure member, being perforated over its entire curved area between the attachments of the membrane to the drum, the air space being defined by said membrane and a further portion of the drum and being arranged so that air under pressure introduced into said space causes the membrane to be urged towards the pressing space.

2. A pneumatically operated press according to claim 1 wherein the internal surface of the side wall in which the outlet openings are formed is smooth and curvilinear.

3. A pneumatically operated press according to claim 1 wherein the drum is cylindrical and a semi-cylindrical portion of the side wall of the drum defines with the membrane the pressing space, the other semi-cylindrical portion of the drum defining with the membrane the air space.

4. A pneumatically operated press according to claim 3 wherein the semi-cylindrical part of the drum defining the pressing space is formed of perforated material.

5. A pneumatically operated press according to claim 3 wherein the inlet is located adjacent the junction between the two semi-cylindrical portions of the drum.

6. A pneumatically operated press according to claim 3 wherein the membrane is attached to the internal surface of the drum adjacent the junctions of the two semi-cylindrical portions of the drum and, adjacent the point of attachment of the membrane to the drum, the membrane lies substantially tangential to the drum and extends in a direction towards the air space.

7. A pneumatically operated press according to claim 6 wherein the operative surface of the membrane corresponds in size to the internal surface of the portion of the side wall defining the pressing space and to the internal surface of the portion of the side wall defining the air space.

* * * * *